US007513234B1

(12) United States Patent
Baldwin et al.

(10) Patent No.: US 7,513,234 B1
(45) Date of Patent: Apr. 7, 2009

(54) PRE-CHAMBER IGNITER HAVING ADJUSTABLE ELECTRODE

(75) Inventors: Darryl D. Baldwin, Lafayette, IN (US); James M. Schultz, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/980,406

(22) Filed: Oct. 31, 2007

(51) Int. Cl.
*F02P 1/00* (2006.01)
*H01T 13/14* (2006.01)

(52) U.S. Cl. ..... 123/169 EA; 123/260; 313/125

(58) Field of Classification Search ..... 123/260, 123/169 EA, 169 EC; 313/125, 143
See application file for complete search history.

(56) References Cited

U.S. PATENT DOCUMENTS 1,101,834 A * 6/1914 Campbell ..... 313/125
1,268,322 A 6/1918 Clark
1,312,317 A 8/1919 Gerken
1,419,904 A 6/1922 Berry
1,572,058 A 2/1926 Winters
1,691,760 A 11/1928 Fox
1,797,817 A 3/1931 Bidwell
1,929,203 A 10/1933 Hahn
1,968,735 A 7/1934 Bizzarro
2,129,003 A 9/1938 Grant
2,168,019 A 8/1939 Watts et al.
2,445,704 A 7/1948 Wolff
2,900,546 A 8/1959 Russell
3,320,461 A 5/1967 Feins
3,389,287 A 6/1968 Wolcott
3,431,450 A 3/1969 Errico

* cited by examiner

*Primary Examiner*—John T Kwon
(74) *Attorney, Agent, or Firm*—Finnegan, Henderson, Farabow, Garrett & Dunner

(57) ABSTRACT

An igniter for an internal combustion engine is disclosed. The igniter may have a body, and a pre-combustion chamber integral with the body and having at least one orifice. The igniter may also have at least one electrode extending into the pre-combustion chamber. The at least one electrode may be configured to direct an arc to an annular side wall of the pre-combustion chamber, and may be movable to adjust an arc termination location on the annular side wall of the pre-combustion chamber.

18 Claims, 3 Drawing Sheets

PRE-CHAMBER IGNITER HAVING ADJUSTABLE ELECTRODE

TECHNICAL FIELD

The present disclosure is directed to a pre-chamber igniter and, more particularly, to a pre-chamber igniter having an adjustable electrode.

BACKGROUND

Engines, including diesel engines, gasoline engines, gaseous fuel powered engines, and other engines known in the art ignite injections of fuel to produce heat. In one example, fuel injected into a combustion chamber of the engine is ignited by way of a spark plug. Specifically, a high voltage current is directed through an electrode located at a center of the spark plug, from a terminal end to a distal free end. The distal free end is spaced a particular distance from a grounded portion of the spark plug such that an arc spanning from the distal free end to the grounded portion is generated. This arc has sufficient voltage to breakdown and thereby ignite an air and fuel mixture within the combustion chamber.

Although successful at initiating combustion, conventional spark plugs suffer from low component life. That is, the associated high breakdown voltage requirement of the spark plug's arc can be damaging to the grounded portion of the spark plug. Over time, the grounded portion may become pitted at the arc termination location and, thereby, change the distance between the electrode and the grounded portion. As this distance increases, arcing reliability is reduced and the spark plug should be replaced to ensure continued operation of the engine.

One attempt at extending the life of a spark plug is described in U.S. Pat. No. 1,268,322 (the '322 patent) issued to Clark on Jun. 4, 1918. The '322 patent discloses a spark plug having a stem electrode with a distal free end located within an integral thimble electrode. A predetermined gap spacing is maintained between the distal free end and an axial end of the thimble electrode by rotating the stem electrode relative to the thimble electrode. As the stem electrode is rotated, it advances axially into the thimble electrode, due to threading of the stem electrode. The stem electrode is advanced until it engages the axial end of the thimble electrode, thereby dislodging any soot or oil built up at the axial end of the thimble electrode or at the distal free end of the stem electrode. After the soot or oil is dislodged, the stem electrode is rotated in a reverse direction to separate the distal free end from the axial end by the predetermined gap spacing. The threading on the stem electrode is of convenient pitch such that a technician may set the gap spacing by turning the stem electrode through a certain number of revolutions.

Although the spark plug of the '322 patent may have extended life compared to non-adjustable spark plugs, it may still lack reliability, applicability, and accuracy. That is, even though oil and soot may be dislodged and the stem electrode may be maintained at the appropriate distance from the axial end of the thimble electrode, the gap spacing may not account for pitting. That is, if pitting occurs at the axial end, the technician may have no way of knowing to what angle the stem should be rotated to avoid arc termination at the same pitting location, as only the spacing from the axial thimble wall is of concern in the '322 patent. And, the adjustment method of the '322 patent may not be applicable to spark plugs with stem electrodes that have radially oriented prongs, where the arc terminates at an annular side wall of the pre-chamber. Further, even though threading of the spark plug disclosed in the '322 patent may be convenient, it may provide opportunities of inaccuracies in stem electrode placement.

The igniter of the present disclosure solves one or more of the problems set forth above.

SUMMARY

One aspect of the present disclosure is directed to an igniter. The igniter may include a body, and a pre-combustion chamber integral with the body and having at least one orifice. The igniter may also have at least one electrode extending into the pre-combustion chamber. The at least one electrode may be configured to direct an arc to an annular side wall of the pre-combustion chamber, and may be movable to adjust an arc termination location on the annular side wall of the pre-combustion chamber Another aspect of the present disclosure is directed to a method of operating an igniter. The method may include directing an arc to an annular sidewall of a pre-combustion chamber. The method may also include adjusting an arc origination location to change an arc termination location at the annular sidewall.

DETAILED DESCRIPTION

Figure 1:
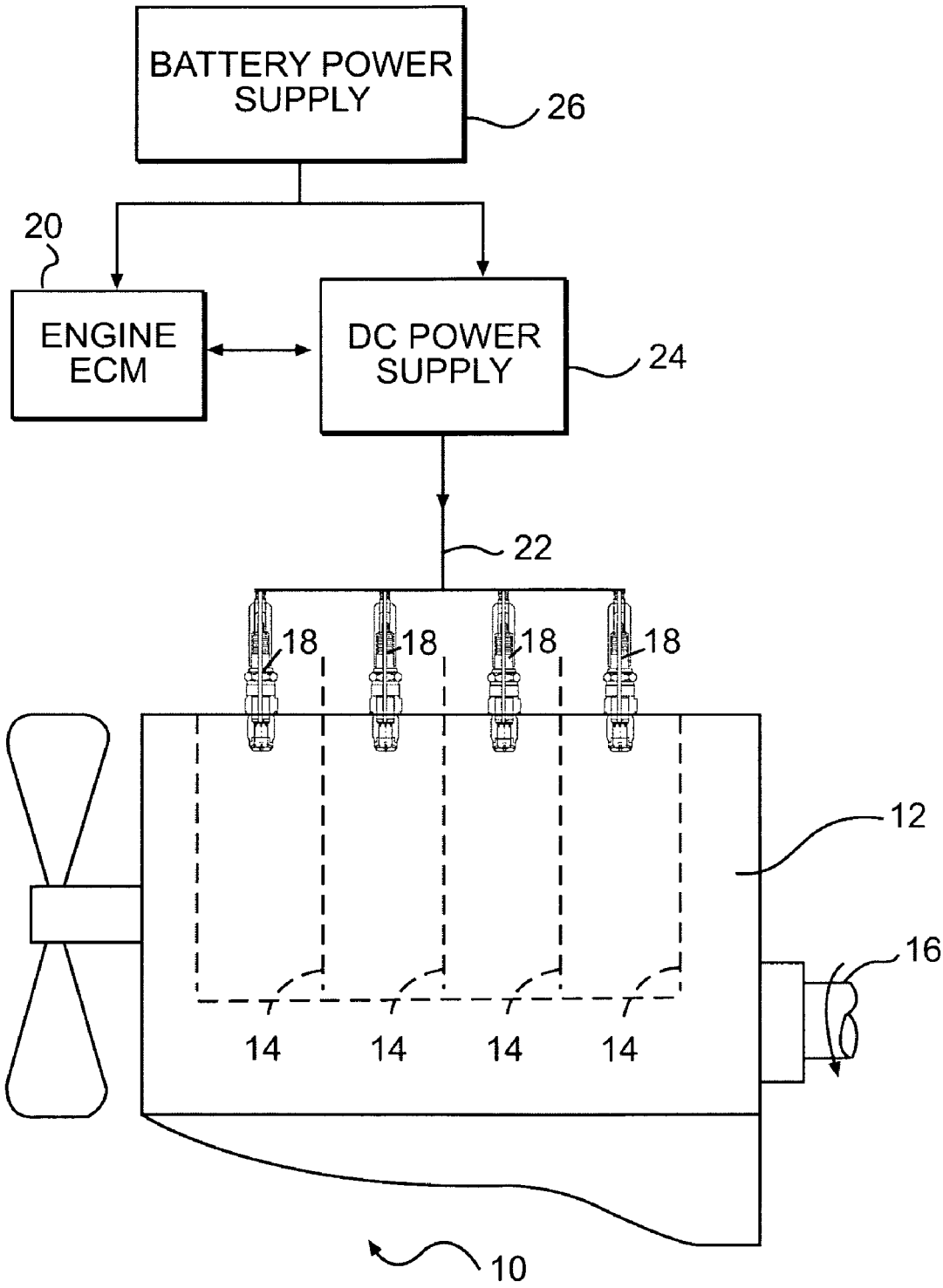
FIG. 1 is a schematic and diagrammatic illustration of an exemplary disclosed power system.

FIG. 1 illustrates a power system 10. Power system 10 may be any type of internal combustion engine such as, for example, a gasoline engine, a gaseous fuel-powered engine, or a diesel engine. Power system 10 may include an engine block 12 that at least partially defines a plurality of combustion chambers 14. In the illustrated embodiment, power system 10 includes four combustion chambers 14. However, it is contemplated that power system 10 may include a greater or lesser number of combustion chambers 14, and that combustion chambers 14 may be disposed in an "in-line" configuration, a "V" configuration, or in any other suitable configuration.

As also shown in FIG. 1, power system 10 may include a crankshaft 16 that is rotatably disposed within engine block 12. A connecting rod (not shown) may connect a plurality of pistons (not shown) to crankshaft 16 so that a sliding motion of each piston within the respective combustion chamber 14 results in a rotation of crankshaft 16. Similarly, a rotation of crankshaft 16 may result in a sliding motion of the pistons.

An igniter 18 may be associated with each combustion chamber 14. Igniter 18 may facilitate ignition of fuel sprayed into combustion chamber 14 during an injection event, and may be timed to coincide with the movement of the piston. Specifically, the fuel within combustion chamber 14, or a mixture of air and fuel, may be ignited by a flame jet propagating from igniter 18 as the piston nears a top-dead-center position during a compression stroke, as the piston leaves the top-dead-center position during a power stroke, or at any other appropriate time.

To facilitate the appropriate ignition timing, igniter 18 may be in communication with and/or actuated by an electronic control module (ECM) 20 via a power supply and communication harness 22. Based on various input received by ECM 20 including, among other things, engine speed, engine load, emissions production or output, engine temperature, engine fueling, and boost pressure, ECM 20 may selectively direct a current from a DC power supply 24 to each igniter 18 via harness 22. It is contemplated that ECM 20 and DC power supply 24 may be combined into a single integral unit, if desired.

ECM 20 may include all the components required to run an application such as, for example, a memory, a secondary storage device, and a processor, such as a central processing unit. One skilled in the art will appreciate that ECM 20 can contain additional or different components than described above. ECM 20 may be dedicated to control of only igniters 18 or, alternatively, may readily embody a general machine or power system microprocessor capable of controlling numerous machine or power system functions. Associated with ECM 20 may be various other known circuits such as, for example, power supply circuitry, signal conditioning circuitry, and solenoid driver circuitry, among others.

A common source, for example an onboard battery power supply 26, may power one or both of ECM 20 and DC power supply 24. In typical vehicular applications, battery power supply 26 may provide 12 or 24 volt current. It should be noted that, during operation of power system 10, ECM 20 and/or DC power supply 24 may receive power from an alternator (not shown) in addition to or instead of battery power supply 26, if desired.

DC power supply 24 may include, among other things a high voltage source of DC power as is typical in most spark-ignited, combustion engine applications. In one embodiment, multiple high voltage sources may be present, with one high voltage source being paired with one igniter 18. In another embodiment, a single high voltage source of DC power may be utilized for multiple igniters 18. In the latter configuration, a distributor (not shown) may be located between the high voltage source and igniters 18 to selectively distribute power to each igniter 18 at an appropriate timing relative to the motion of the engine's pistons. DC power supply 24 may generate a high voltage DC current, and direct this current to igniters 18.

Figure 2:
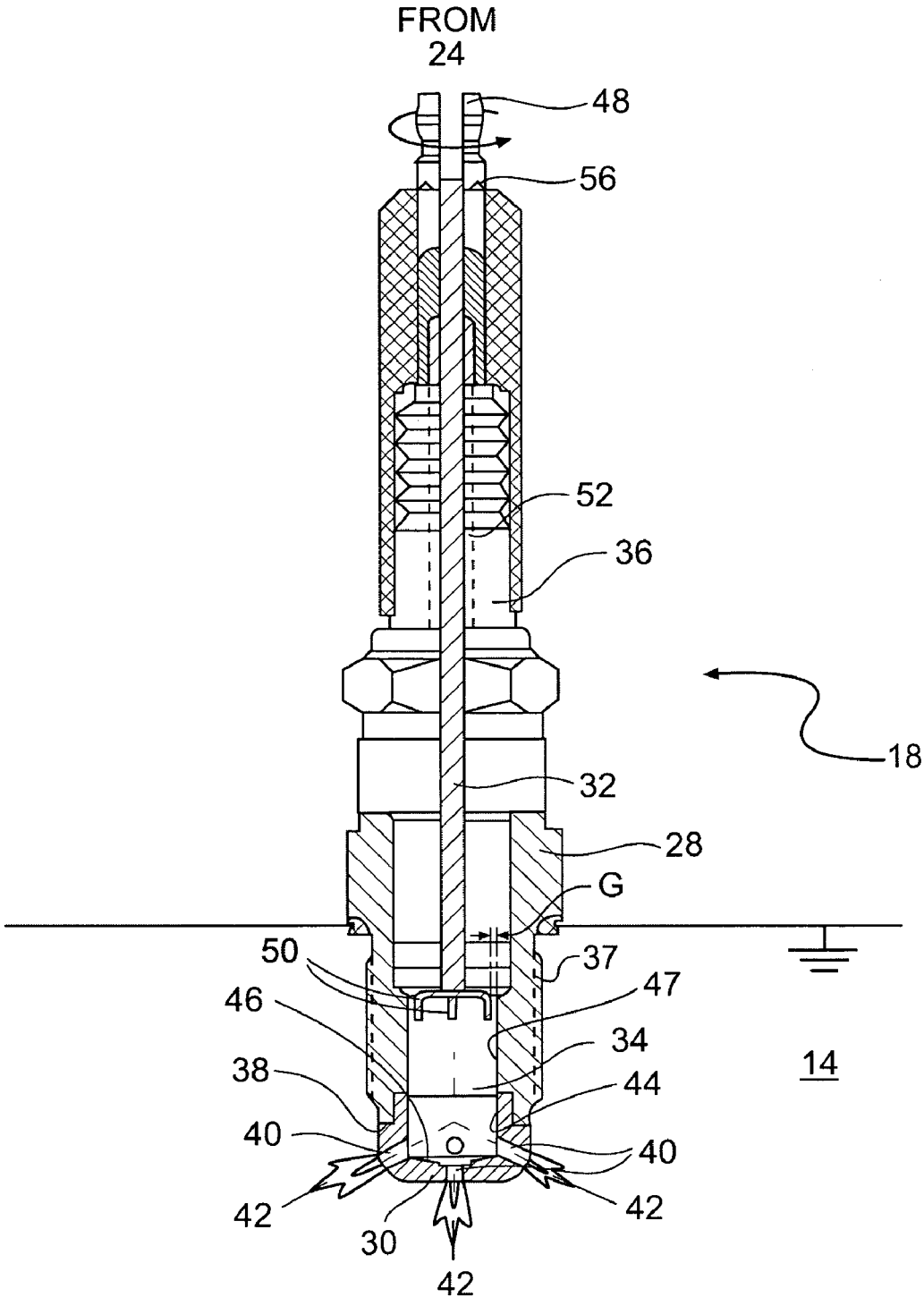
FIG. 2 is a cross-sectional illustration an exemplary disclosed igniter that may be used with the power system of FIG. 1.

As illustrated in FIG. 2, igniter 18 may include multiple components that cooperate to ignite the air and fuel mixture within combustion chamber 14. In particular, igniter 18 may include a body 28, a cap 30, and a single electrode 32. Body 28 may be generally hollow at one end and, together with cap 30, may at least partially define an integral pre-combustion chamber 34 (also known as a pre-chamber). Electrode 32 may extend from a terminal end 48 of igniter 18 through body 28 and at least partially into pre-combustion chamber 34. In one embodiment, an insulator 36 may be disposed between body 28 and electrode 32 to electrically, thermally, and/or vibrationally isolate electrode 32 from body 28.

Body 28 may be a generally cylindrical structure fabricated from an electrically conductive material such as steel. In one embodiment, body 28 may include external threads 37 configured for direct engagement with engine block 12 or with a cylinder head (not shown) fastened to engine block 12 to cap off combustion chamber 14. In this configuration, body 28 may be electrically grounded via the connection with engine block 12 or the cylinder head.

Cap 30 may have a cup-like shape and be fixedly connected to an end 38 of body 28. Cap 30 may be welded, press-fitted, threadingly engaged, or otherwise fixedly connected to body 28. Cap 30 may include a plurality of orifices 40 that facilitate the flow of air and fuel into pre-combustion chamber 34 and the passage of flame jets 42 from pre-combustion chamber 34 into combustion chamber 14 of engine block 12. Orifices 40 may pass generally radially through an annular side wall 44 of cap 30 and/or through an end wall 46 of cap 30.

Electrode 32 may be fabricated from an electrically conductive metal such as, for example, tungsten, iridium, silver, platinum, and gold palladium, and be configured to direct current from DC power supply 24 to ignite the air and fuel mixture within combustion chambers 14. In one embodiment, a plurality of prongs 50 may extend generally radially toward an internal annular wall 47 of pre-combustion chamber 34, such that an arc created by the DC current may be directed toward and terminate at wall 47.

Prongs 50 may be spaced from wall 47 by a gap "G". Gap "G" may have a spacing selected such that an arc having sufficient breakdown voltage spans from prongs 50 to wall 47 when current is directed to electrode 32. Over time, material may build within Gap "G", and/or wall 47 may pit at an arc termination location. If unaccounted for, this material or the pitting may change the spacing of gap "G" and affect the breakdown voltage of the arc. If severe enough, the change in breakdown voltage could result in poor operation of power system 10.

To ensure the appropriate spacing of gap "G" is maintained, the location and/or orientation of electrode 32 may be adjusted. That is, electrode 32 may be moved axially relative to body 28 and/or pre-combustion chamber 34, as well as angularly re-oriented about a longitudinal axis such that arcs originating from distal free ends of prongs 50 terminate at different (i.e., non-pitted) locations on wall 47. To facilitate the movement of electrode 32, electrode 32 may be loosely received by insulator 36 and/or body 28. In one embodiment, electrode 32 may be connected to insulator 36 by way of threading 52. A recess 54 located at terminal end 48 of igniter 18 may accommodate a tool (not shown), for example an Allen wrench. As the tool is rotated, electrode 32 and connected prongs 50 may also rotate relative to insulator 36 and/or body 28. If threaded, when terminal end 48 is rotated, electrode 32 may slide relative to terminal end 48 and move axially into or out of pre-combustion chamber 34. It is contemplated that insulator 36 may alternatively rotate with electrode 32 relative to body 28, if desired.

In some situations, a precision of electrode rotation may be important. That is, if pitting of wall 47 has occurred, it may be desired to rotate electrode 32 until the arcs originating from prongs 50 terminate at wall locations with minimal pitting. In this situation, the required rotation angle may be somewhat related to the number of prongs 50 included within igniter 18. For example, if four prongs are included within igniter 18 and pitting has occurred at the wall locations adjacent each prong 50, the most likely wall location without pitting would be about halfway between the current prong locations. Thus, electrode 32 may be rotated by about 45 degrees to provide an arc termination location on wall 47 free of pitting for each prong 50. In an example where only two prongs 50 are included, the most likely wall location with minimal pitting would be at about 90 degrees of electrode rotation. Thus the relationship between electrode rotation and the number of prongs may be represented by the following equation:

$$A_{Rotation} = \frac{360}{2 \times P} \qquad \text{Eq. 1}$$

wherein:

$A_{Rotation}$ is the angle of rotation most likely to provide an arc termination location free of pitting; and P is the number of prongs 50.

By rotating electrode 32 to $A_{Rotation}$, a life of igniter 18 may be about doubled. To extend the life of igniter 18 even further, electrode 32 may instead be rotated to a fraction of $A_{Rotation}$. For example, for a component life of about four times a conventional igniter life, electrode 32 may be rotated to about one half of $A_{Rotation}$, thereby allowing three additional rotations by about the same angle before igniter 18 should be replaced.

To help ensure precision in rotation of electrode 32, an accuracy mechanism 56 may be provided. In one embodiment, accuracy mechanism 56 may include detents that correspond with a rotation of $A_{Rotation}$, or with a fractional rotation of $A_{Rotation}$. In this embodiment, a technician may be able to feel, hear, and/or see incremental rotations of electrode 32. In another embodiment, accuracy mechanism 56 may simply include an angular index marked at terminal end 48. In this latter embodiment, an operator may be able to see the rotation affected during adjustment of electrode 32.

A securing device (not shown) may retain electrode 32 in place between adjustment events. For example, a set nut (not shown) may be associated with terminal end 48 to lock terminal end 48 and/or electrode 32 to insulator 36 and/or body 28. Alternatively, electrode 32 may be spring-biased to engage the detents described above. In yet another embodiment, a set screw (not shown) may be located to radially engage electrode 32 and, thereby lock electrode 32 to insulator 36 and/or body 28. It is contemplated that many other ways of locking electrode 32 may be utilized, if desired.

Figure 3:
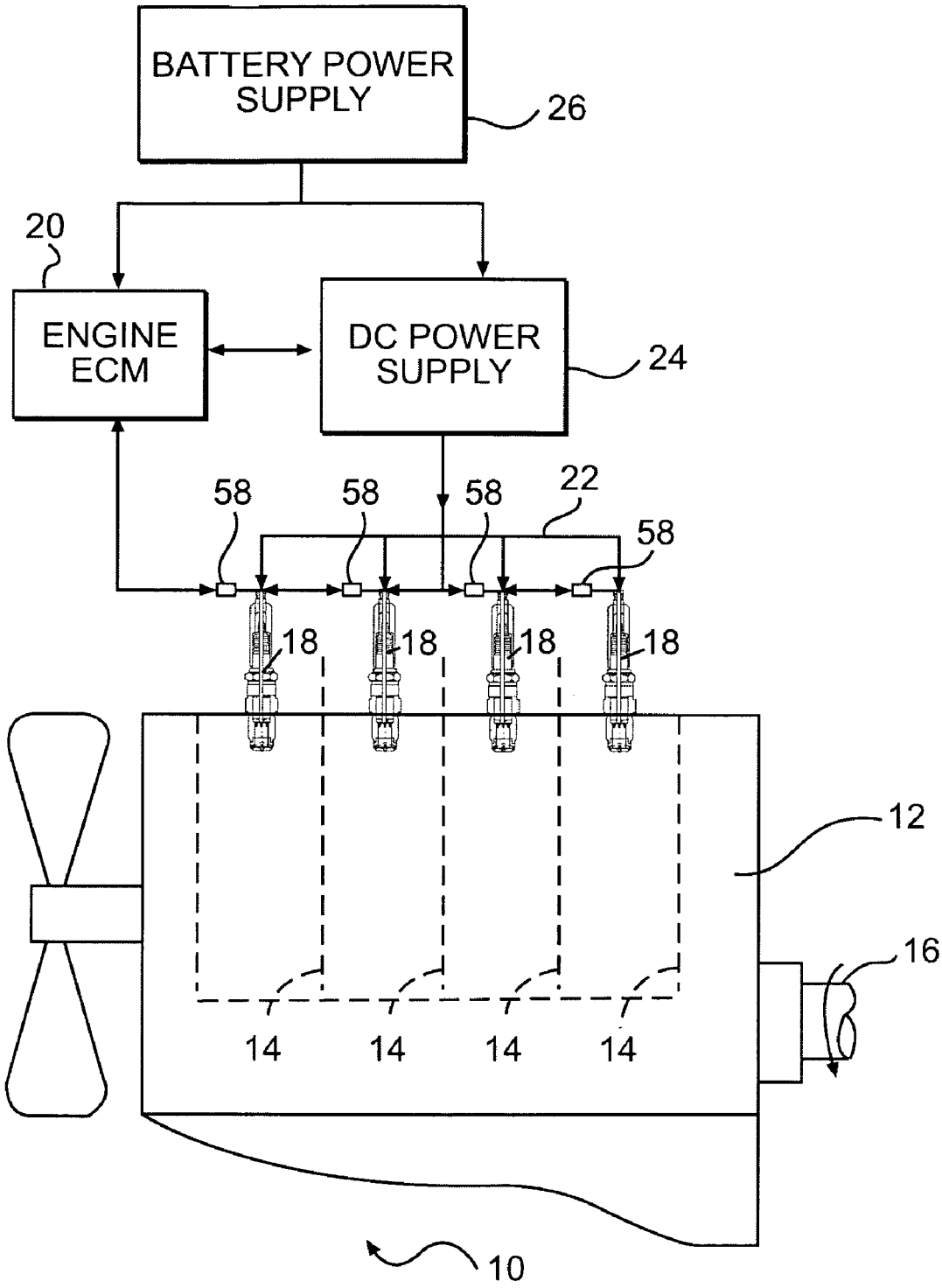
FIG. 3 is a schematic and diagrammatic illustration of another exemplary disclosed power system.

In some situations, it may be difficult to determine when adjustment of electrode 32 is required. If rotated before excessive pitting has occurred, igniter 18 may be prematurely replaced. If rotated too late relative to the pitting, poor power system performance may be experienced. To optimize igniter life and power system performance, electrode adjustment may be performed automatically in response to one or more performance related parameters. FIG. 3 illustrates power system 10 having automated igniter adjustment. In this embodiment, an actuator 58 may be associated with terminal end 48 of each igniter 18. It is contemplated that one actuator 58 may be configured to adjust only one igniter 18 or multiple igniters 18.

Actuator 58 may be in communication with ECM 20 and connected to rotate electrode 32 of igniter 18. In one embodiment, actuator 58 may be, for example, a stepwise or continuous rotary motor. Upon receiving a signal from ECM 20, actuator 58 may be energized to rotate electrode 32 through $A_{Rotation}$. Actuator 58 may include any pneumatic, hydraulic, mechanical or electro-magnetic element known in the art for achieving the necessary adjustment of electrode 32. It is contemplated that, instead of a rotary motor, actuator 58 may alternatively embody a linear motor, if desired.

The performance parameters indicating a need for electrode adjustment may include any commonly known power system or igniter related parameters. In one example, the performance parameter may be associated with an elapsed period of igniter or power system operation. That is, igniter 18 may be designed to operate for a known period of time before pitting of wall 47 occurs. Thus, actuator 58 may be regulated to adjust the position and/or orientation of electrode 32 prior to expiration of the known period of time. In another example, actuator 58 may be energized to adjust electrode 32 in response to a sensed parameter such as an electrical characteristic (i.e., voltage, amperage, resistance, etc.) associated with the power supplied to igniter 18 or the resulting arc extending from electrode 32 to wall 47 of pre-combustion chamber 34.

INDUSTRIAL APPLICABILITY

The igniter of the present disclosure may be applicable to any combustion-type power source. The disclosed igniter may have improved component life by providing for adjustability of an associated electrode after damaging wear has occurred. The operation of power system 10 will now be described.

Referring to FIG. 1, air and fuel may be drawn into combustion chambers 14 of power system 10 for subsequent combustion. Specifically, fuel may be injected into combustion chambers 14 of power system 10, mixed with the air therein (or, alternatively premixed with the air and then introduced into combustion chambers 14), and combusted by power system 10 to produce a mechanical work output and an exhaust flow of hot gases.

Referring to FIGS. 2 and 3, as the injected fuel within combustion chambers 14 mixes with air, some of the mixture may enter pre-combustion chamber 34 of igniter 18 via orifices 40 during an intake and/or compression stroke of the associated piston. At an appropriate timing relative to the motion of the pistons within combustion chambers 14, as detected or determined by ECM 20, ECM 20 may control DC power supply 24 to direct a current to igniters 18 that produce a high voltage arc extending from electrode 32 to internal wall 47 of pre-combustion chamber 34. As the air and fuel mixture ignites within pre-combustion chamber 34, flame jets 42 may propagate through orifices 40 into combustion chambers 14 of the engine block, where the remaining air and fuel mixture may be efficiently combusted.

After a period of operation, pitting may occur at arc termination points on wall 47. To ensure continued proper operation of power system 10, electrode 32 may be rotated through $A_{Rotation}$ or a fraction thereof, depending on a desired life of igniter 18. The rotation of electrode 32 may be accomplished manually via a tool inserted into terminal end 48, or automatically by actuator 58 in response to one or more performance parameters.

It will be apparent to those skilled in the art that various modifications and variations can be made to the igniter of the present disclosure without departing from the scope of the disclosure. Other embodiments will be apparent to those skilled in the art from consideration of the specification and practice of the igniter disclosed herein. It is intended that the specification and examples be considered as exemplary only, with a true scope of the disclosure being indicated by the following claims and their equivalents.

What is claimed is:

1. An igniter, comprising:

a body;

a pre-combustion chamber integral with the body and having at least one orifice;

an electrode extending into the pre-combustion chamber and configured to direct an arc to an annular side wall of the pre-combustion chamber, wherein the electrode is movable to adjust an arc termination location on the annular side wall of the pre-combustion chamber; and an actuator configured to affect movement of the electrode.

2. The igniter of claim 1, wherein the electrode is movable relative to the body.

3. The igniter of claim 1, wherein the electrode is axially movable.

4. The igniter of claim 1, wherein the electrode is rotatable.

5. The igniter of claim 1, further including a detent configured to affect movement of the electrode.

6. The igniter of claim 1, further including a plurality of prongs extending generally radially from the electrode toward the annular side wall of the pre-chamber.

7. The igniter of claim 6, wherein the electrode is movable through an angle corresponding to the number of the plurality of prongs.

8. The igniter of claim 7, wherein:

the number of prongs is four; and the electrode is movable by 45° increments.

9. The igniter of claim 1, wherein the electrode is also movable to affect a distance from a distal free end of the electrode to an axial end of the pre-combustion chamber.

10. The igniter of claim 1, wherein operation of the actuator is regulated based on an operational parameter.

11. The igniter of claim 10, wherein the operational parameter is related to an elapsed period of time.

12. The igniter of claim 10, wherein the operational parameter is related to a sensed characteristic of the arc.

13. A method of operating an engine, comprising:

directing an arc to an annular sidewall of a pre-combustion chamber; and automatically adjusting an arc origination location to change an arc termination location at the annular sidewall based on an operational parameter.

14. The method of claim 13, wherein adjusting includes re-orienting the arc origination location.

15. The method of claim 13, wherein the operational parameter is an elapsed period of operation.

16. The method of claim 13, wherein the operational parameter is a measured characteristic of the arc.

17. The method of claim 13, wherein adjusting is performed in discrete increments.

18. A power system, comprising:

an engine block at least partially defining a combustion chamber;

a power source configured to produce a DC current; and an igniter fluidly communicated with the combustion chamber and electrically communicated with the power source, the igniter including:

an integral pre-combustion chamber;

a plurality of orifices fluidly communicating the integral pre-combustion chamber with the combustion chamber of the engine block; and an electrode extending at least partially into the integral pre-combustion chamber and being configured to direct an arc to an annular side wall of the pre-combustion chamber, wherein the electrode is movable relative to the pre-combustion chamber to adjust an arc termination location on the annular side wall.

* * * * *